US008579207B2

(12) United States Patent
Sturman

(10) Patent No.: US 8,579,207 B2
(45) Date of Patent: Nov. 12, 2013

(54) MULTIPLE INTENSIFIER INJECTORS WITH POSITIVE NEEDLE CONTROL AND METHODS OF INJECTION

(75) Inventor: Oded Eddie Sturman, Woodland Park, CO (US)

(73) Assignee: Sturman Digital Systems, LLC, Woodland Park, CO (US)

( * ) Notice: Subject to any disclaimer, the term of this patent is extended or adjusted under 35 U.S.C. 154(b) by 48 days.

(21) Appl. No.: 12/751,118

(22) Filed: Mar. 31, 2010

(65) Prior Publication Data

US 2010/0186716 A1 Jul. 29, 2010

Related U.S. Application Data

(62) Division of application No. 12/118,542, filed on May 9, 2008, now Pat. No. 7,717,359.

(60) Provisional application No. 60/928,578, filed on May 9, 2007.

(51) Int. Cl.

| | |
|---|---|
| ***F02M 47/02*** | (2006.01) |
| ***F02M 45/10*** | (2006.01) |
| ***F02M 57/02*** | (2006.01) |
| ***F02M 63/00*** | (2006.01) |
| ***B05B 9/00*** | (2006.01) |

(52) U.S. Cl.
USPC ..... 239/5; 239/88; 239/89; 239/93; 239/125; 239/126; 123/446; 123/447

(58) Field of Classification Search
USPC ..... 239/5, 533.1–533.15, 88–92, 93, 125, 239/126; 123/446, 447
See application file for complete search history.

(56) References Cited

U.S. PATENT DOCUMENTS

| | | | | |
|---|---|---|---|---|
| 1,701,089 | A | 2/1929 | von Salis | |
| 2,537,087 | A * | 1/1951 | Herman et al. | 123/446 |
| 2,606,066 | A * | 8/1952 | Thompson | 239/76 |

(Continued)

FOREIGN PATENT DOCUMENTS

| | | |
|---|---|---|
| DE | 10250130 | 3/2004 |
| DE | 102004030447 | 1/2006 |
| DE | 102005028400 | 2/2006 |
| DE | 102005060647 | 6/2006 |
| EP | 1593839 | 11/2005 |
| JP | 61-008459 | 1/1986 |

(Continued)

OTHER PUBLICATIONS

"International Search Report and Written Opinion of the International Searching Authority Dated Aug. 21, 2008", International Application No. PCT/US2008/063321.

(Continued)

*Primary Examiner* — Len Tran
*Assistant Examiner* — Justin Jonaitis
(74) *Attorney, Agent, or Firm* — Blakely Sokoloff Taylor & Zafman LLP

(57) ABSTRACT

Multiple intensifier injectors with positive needle control and methods of injection that reduce injector energy consumption. The intensifiers are disposed about the axis of the injectors, leaving the center free for direct needle control down the center of the injector. Also disclosed is a boost system, increasing the needle closing velocity but without adding mass to the needle when finally closing. Direct needle control allows maintaining injection pressure on the fuel between injection events if the control system determines that enough fuel has been pressurized for the next injection, thus saving substantial energy when operating an engine at less than maximum power, by not venting and re-pressurizing on every injection event.

16 Claims, 3 Drawing Sheets

(56) References Cited

U.S. PATENT DOCUMENTS

| | | | | |
|---|---|---|---|---|
| 2,722,924 | A | 11/1955 | Hedges | |
| 3,640,466 | A * | 2/1972 | Steiger | 239/94 |
| 4,006,859 | A | 2/1977 | Thoma | |
| 4,173,208 | A | 11/1979 | Fenne et al. | |
| 4,256,064 | A | 3/1981 | Thorn | |
| 4,440,132 | A | 4/1984 | Terada et al. | |
| 4,627,571 | A | 12/1986 | Kato et al. | |
| 4,782,794 | A * | 11/1988 | Hsu et al. | 123/23 |
| 4,821,689 | A | 4/1989 | Tittizer et al. | |
| 4,856,713 | A | 8/1989 | Burnett | |
| 5,108,070 | A | 4/1992 | Tominaga | |
| 5,237,976 | A | 8/1993 | Lawrence et al. | |
| 5,341,783 | A | 8/1994 | Beck et al. | |
| 5,419,492 | A | 5/1995 | Gant et al. | |
| 5,421,521 | A | 6/1995 | Gibson et al. | |
| 5,423,484 | A | 6/1995 | Zuo | |
| 5,429,309 | A | 7/1995 | Stockner | |
| 5,440,968 | A | 8/1995 | Sekine | |
| 5,441,027 | A | 8/1995 | Buchanon et al. | |
| 5,460,329 | A | 10/1995 | Sturman | |
| 5,463,996 | A | 11/1995 | Maley et al. | |
| RE35,303 | E | 7/1996 | Miller et al. | |
| 5,551,398 | A | 9/1996 | Gibson et al. | |
| 5,638,781 | A | 6/1997 | Sturman | |
| 5,640,987 | A | 6/1997 | Sturman | |
| 5,641,121 | A | 6/1997 | Beck et al. | |
| 5,669,355 | A | 9/1997 | Gibson et al. | |
| 5,673,669 | A | 10/1997 | Maley et al. | |
| 5,682,858 | A | 11/1997 | Chen et al. | |
| 5,687,693 | A | 11/1997 | Chen et al. | |
| 5,697,342 | A | 12/1997 | Anderson et al. | |
| 5,713,316 | A | 2/1998 | Sturman | |
| 5,722,373 | A | 3/1998 | Paul et al. | |
| 5,727,525 | A | 3/1998 | Tsuzuki | |
| 5,732,679 | A * | 3/1998 | Takahasi et al. | 123/467 |
| 5,738,075 | A | 4/1998 | Chen et al. | |
| 5,752,659 | A | 5/1998 | Moncelle | |
| 5,771,865 | A | 6/1998 | Ishida | |
| 5,779,149 | A | 7/1998 | Hayes, Jr. | |
| 5,806,474 | A | 9/1998 | Paul et al. | |
| 5,826,562 | A | 10/1998 | Chen et al. | |
| 5,833,146 | A | 11/1998 | Hefler | |
| 5,873,526 | A | 2/1999 | Cooke | |
| 5,906,351 | A | 5/1999 | Aardema et al. | |
| 5,941,215 | A | 8/1999 | Augustin | |
| 5,950,931 | A | 9/1999 | Beatty et al. | |
| 5,954,030 | A | 9/1999 | Sturman et al. | |
| 5,960,753 | A | 10/1999 | Sturman | |
| 5,970,956 | A | 10/1999 | Sturman | |
| 5,979,803 | A | 11/1999 | Peters et al. | |
| 6,012,430 | A | 1/2000 | Cooke | |
| 6,012,644 | A | 1/2000 | Sturman et al. | |
| 6,026,785 | A | 2/2000 | Zuo | |
| 6,027,047 | A | 2/2000 | Augustin | |
| 6,047,899 | A | 4/2000 | Graves | |
| 6,085,991 | A | 7/2000 | Sturman | |
| 6,112,721 | A | 9/2000 | Kouketsu et al. | |
| 6,113,000 | A | 9/2000 | Tian | |
| 6,113,014 | A | 9/2000 | Coldren et al. | |
| 6,119,960 | A | 9/2000 | Graves | |
| 6,148,778 | A | 11/2000 | Sturman | |
| 6,161,770 | A | 12/2000 | Sturman | |
| 6,173,685 | B1 | 1/2001 | Sturman | |
| 6,257,499 | B1 | 7/2001 | Sturman | |
| 6,308,690 | B1 | 10/2001 | Sturman | |
| 6,328,003 | B1 | 12/2001 | Gaertner et al. | |
| 6,360,728 | B1 | 3/2002 | Sturman | |
| 6,374,784 | B1 | 4/2002 | Tischer et al. | |
| 6,378,497 | B1 | 4/2002 | Keyster et al. | |
| 6,412,706 | B1 | 7/2002 | Guerrassi et al. | |
| 6,415,749 | B1 | 7/2002 | Sturman et al. | |
| 6,474,304 | B1 | 11/2002 | Lei | |
| 6,550,453 | B1 | 4/2003 | Tian | |
| 6,557,506 | B2 | 5/2003 | Sturman | |
| 6,575,126 | B2 | 6/2003 | Sturman | |
| 6,575,384 | B2 | 6/2003 | Ricco | |
| 6,592,050 | B2 | 7/2003 | Boecking | |
| 6,647,966 | B2 | 11/2003 | Tian et al. | |
| 6,655,355 | B2 | 12/2003 | Kropp et al. | |
| 6,684,853 | B1 | 2/2004 | Lei | |
| 6,684,856 | B2 | 2/2004 | Tanabe et al. | |
| 6,684,857 | B2 | 2/2004 | Boecking | |
| 6,722,127 | B2 | 4/2004 | Scuderi et al. | |
| 6,745,958 | B2 | 6/2004 | Lei | |
| 6,766,792 | B2 | 7/2004 | Messinger et al. | |
| 6,769,635 | B2 | 8/2004 | Stewart et al. | |
| 6,776,138 | B2 | 8/2004 | Mahr et al. | |
| 6,802,298 | B2 | 10/2004 | Yoshimura et al. | |
| 6,811,103 | B2 | 11/2004 | Gurich et al. | |
| 6,830,202 | B2 | 12/2004 | Coldren | |
| 6,845,926 | B2 | 1/2005 | Lei | |
| 6,868,831 | B2 | 3/2005 | Lei | |
| 6,880,501 | B2 | 4/2005 | Suh et al. | |
| 6,908,040 | B2 | 6/2005 | Dong et al. | |
| 6,910,462 | B2 | 6/2005 | Sun et al. | |
| 6,910,463 | B2 | 6/2005 | Oshizawa et al. | |
| 6,918,358 | B2 | 7/2005 | Hu | |
| 6,951,204 | B2 | 10/2005 | Shafer et al. | |
| 7,108,200 | B2 | 9/2006 | Sturman | |
| 7,182,068 | B1 | 2/2007 | Sturman et al. | |
| 7,278,593 | B2 | 10/2007 | Wang et al. | |
| 7,293,547 | B2 | 11/2007 | Ibrahim | |
| 7,412,969 | B2 | 8/2008 | Pena et al. | |
| 7,568,632 | B2 | 8/2009 | Sturman | |
| 7,568,633 | B2 | 8/2009 | Sturman | |
| 7,694,891 | B2 | 4/2010 | Sturman | |
| 7,717,359 | B2 | 5/2010 | Sturman | |
| 7,753,037 | B2 | 7/2010 | Hatamura | |
| 7,841,324 | B2 | 11/2010 | Dirker et al. | |
| 2002/0053340 | A1 | 5/2002 | Lei | |
| 2003/0155437 | A1 | 8/2003 | Lei | |
| 2003/0178508 | A1 | 9/2003 | Coldren | |
| 2003/0183198 | A1 | 10/2003 | Mahr et al. | |
| 2003/0196646 | A1 | 10/2003 | Shoyama et al. | |
| 2004/0000600 | A1 | 1/2004 | Peters et al. | |
| 2004/0129255 | A1 | 7/2004 | Stuhldreher et al. | |
| 2004/0140161 | A1 | 7/2004 | Clancy et al. | |
| 2004/0168673 | A1 | 9/2004 | Shinogle | |
| 2004/0188537 | A1 | 9/2004 | Sturman | |
| 2004/0195385 | A1 | 10/2004 | Lawrence et al. | |
| 2004/0238657 | A1 * | 12/2004 | Sturman | 239/88 |
| 2005/0066918 | A1 | 3/2005 | Yamakawa et al. | |
| 2005/0092306 | A1 | 5/2005 | Shinogle et al. | |
| 2006/0032940 | A1 | 2/2006 | Boecking | |
| 2006/0075995 | A1 | 4/2006 | Liu et al. | |
| 2006/0123773 | A1 | 6/2006 | Zhang | |
| 2006/0150954 | A1 | 7/2006 | Moore | |
| 2006/0157581 | A1 | 7/2006 | Kiss et al. | |
| 2006/0243253 | A1 | 11/2006 | Knight | |
| 2007/0209615 | A1 | 9/2007 | Epshteyn | |
| 2007/0251220 | A1 | 11/2007 | Dawson et al. | |
| 2007/0272221 | A1 | 11/2007 | Branyon et al. | |
| 2009/0056670 | A1 | 3/2009 | Zhao et al. | |
| 2009/0151686 | A1 | 6/2009 | Nguyen | |
| 2009/0283061 | A1 | 11/2009 | Branyon et al. | |
| 2010/0012745 | A1 | 1/2010 | Sturman | |
| 2011/0094462 | A1 | 4/2011 | Durrett et al. | |
| 2011/0163177 | A1 | 7/2011 | Kiss | |

FOREIGN PATENT DOCUMENTS

| | | |
|---|---|---|
| JP | 61/008459 | 1/1986 |
| JP | 61/096169 | 5/1986 |
| WO | WO-02/073024 | 9/2002 |
| WO | WO-2006/008727 | 1/2006 |
| WO | WO-2008/141237 | 11/2008 |

OTHER PUBLICATIONS

"International Search Report and Written Opinion of the International Searching Authority Dated Jan. 25, 2010", International Application No. PCT/US2009/050736.

(56) References Cited

OTHER PUBLICATIONS

"Office Action Dated Jul. 13, 2012, European Patent Application No. 09790488.2", (Jul. 13, 2012).
"Office Action Dated Sep. 13, 2011, European Patent Application No. 09790488.2", (Sep. 13, 2011).
"Office Action Dated Aug. 23, 2012, U.S. Appl. No. 12/502,827", (Aug. 23, 2012).
"Office Action Dated Aug. 31, 2012; Chinese Patent Application No. 200980136227.6", (Aug. 31, 2012).
"Office Action Dated May 22, 2012, U.S. Appl. No. 12/502,827", (May 22, 2012).
"Notice of Allowance Mailed Dec. 30, 2009, U.S. Appl. No. 12/118,542", (Dec. 30, 2009).
"Notice of Allowance Mailed Jun. 27, 2011, Chinese Patent Application No. 200880015290.X", (Jun. 27, 2011).
"Office Action Dated Dec. 31, 2010, Chinese Patent Application No. 200880015290.X", (Dec. 31, 2010).
"Office Action Dated Dec. 5, 2012, Chinese Patent Application No. 201110259364.8", (Dec. 5, 2012).
"Restriction Requirement Dated Mar. 12, 2013, U.S. Appl. No. 13/683,044", (Mar. 12, 2013).
"Notification on Grant of Patent Right for Invention Dated May 30, 2013; Chinese Patent Application No. 201110259364.8".
"Office Action Dated Apr. 22, 2013; Chinese Patent Application No. 200980136227.6", (Apr. 22, 2013).
"Office Action Dated Apr. 25, 2013, U.S. Appl. No. 13/683,044", (Apr. 25, 2013).

* cited by examiner

MULTIPLE INTENSIFIER INJECTORS WITH POSITIVE NEEDLE CONTROL AND METHODS OF INJECTION

CROSS-REFERENCE TO RELATED APPLICATION

This application is a divisional of U.S. patent application Ser. No. 12/118,542 filed May 9, 2008 which claims the benefit of U.S. Provisional Patent Application No. 60/928,578 filed May 9, 2007.

BACKGROUND OF THE INVENTION

1. Field of the Invention

The present invention relates to the field of fuel injectors.

2. Prior Art

Intensifier type fuel injectors are well known in the prior art. Such injectors use a larger first piston driven by a working fluid under pressure to drive a smaller piston to pressurize fuel for injection. Piston area ratios and thus intensification ratios typically on the order of 10 to 1 allow high injection pressures with only moderate pressure working fluid. Diesel fuel is fairly compressible at the applicable pressures. By way of example, diesel fuel compresses approximately 1% per 1000 psi. With injection pressures of 30,000 psi and higher, the compression of the fuel is substantial. The energy required for compression of the fuel not used for an injection event is generally wasted by the venting of the working fluid over the larger piston of the intensifier to a low pressure reservoir. Consequently, when an engine is running at substantially less than full power, a substantial part of the energy used for compression of a full injection charge is wasted.

Also in diesel fuel injectors, it is important to obtain a sharp start and stop of injection. A slow termination of injection, such as by a slowly decreasing injection pressure, results in poor atomization, or even no real atomization at the end of injection, resulting in incomplete combustion of the fuel, and unacceptable unburned hydrocarbon emissions.

DETAILED DESCRIPTION OF THE PREFERRED EMBODIMENTS

Figure 1:
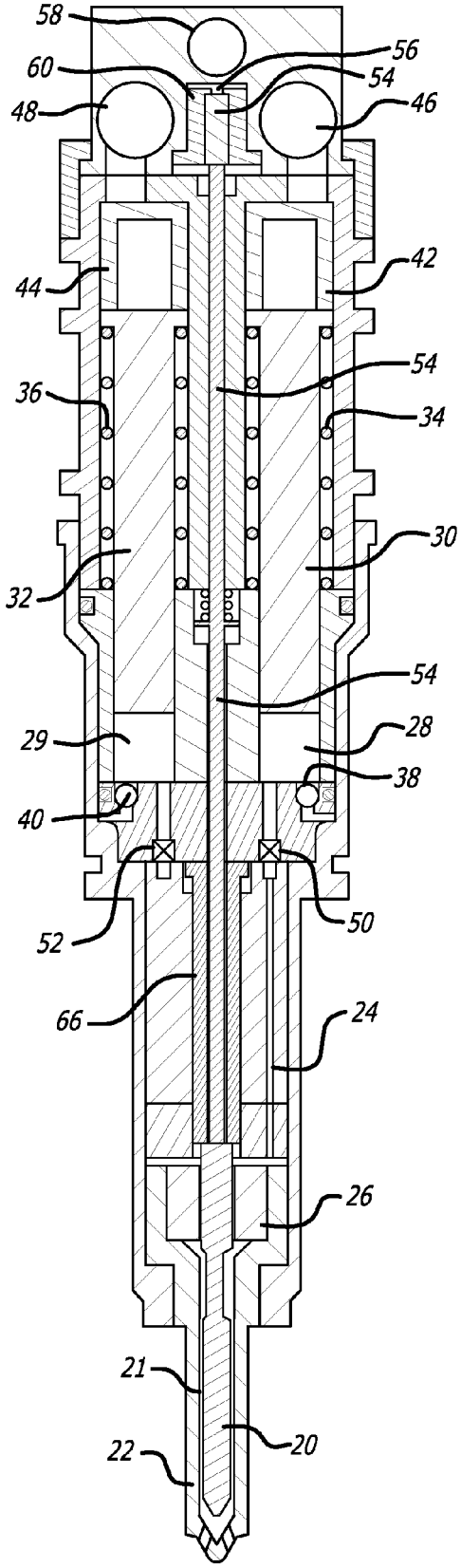
FIG. 1 is a cross section of one embodiment of the present invention.
Figure 2:
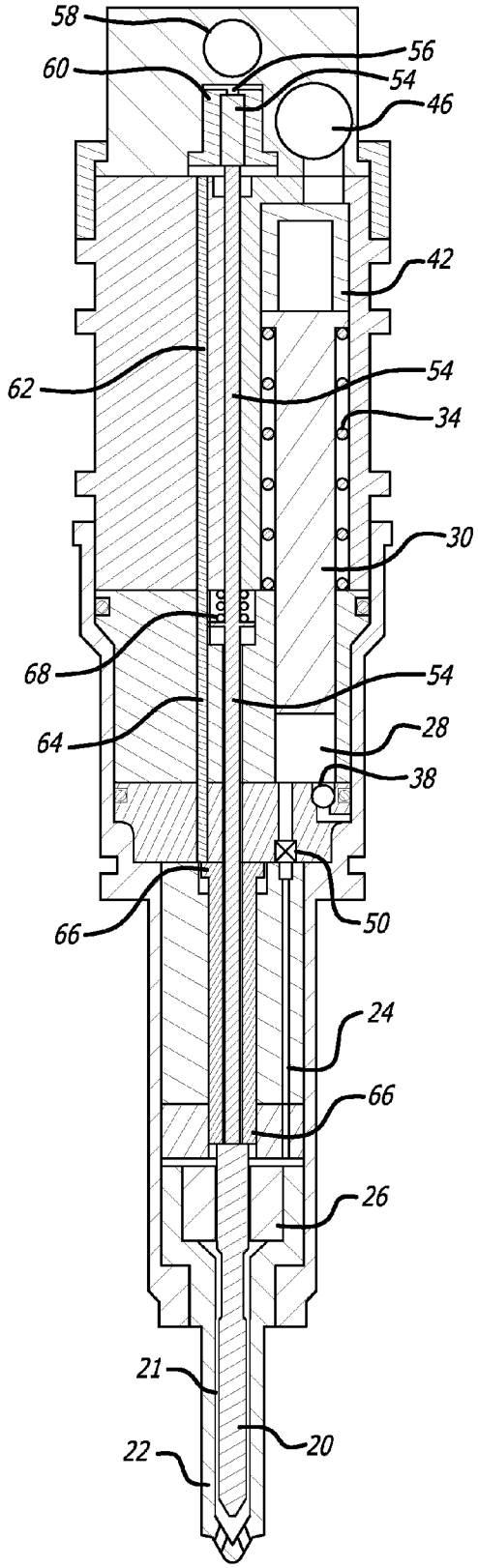
FIG. 2 is a cross section of the embodiment of FIG. 1 showing half sections taken 90 degrees apart.

FIGS. 1 and 2 illustrate an injector in accordance with the present invention. These Figures illustrate the injector in the needle open position, as during injection. FIG. 1 is a cross-section of an injector having two intensifiers, while FIG. 2 is a cross-section of the same injector illustrating the same cross-section on the right half of the Figure, though illustrating a cross-section ninety degrees therefrom on the left half of the Figure. In this injector, a needle 20 is provided which is almost pressure balanced so that when fuel at injection pressures is present in the needle chamber around the needle, there will be a relatively modest upward force on the needle.

Fuel is delivered to the needle chamber 21 in the injector tip 22 through port 24 and slots in member 26 from either or both intensifier chambers 28 and 29. The intensifier pistons 30 and 32 have spring returns 34 and 36 and are supplied with fuel on their return to the upper position through check valves 38 and 40. The intensifiers are powered by pistons 42 and 44, as controlled by control valves 46 and 48, respectively, preferably solenoid actuated spool valves. If fuel is being delivered to the needle chamber 21 by one intensifier only through the channel under the check valves and channels 24, then the other of check valves 50 and 52 will close, preventing the intensified pressure from being coupled to the non-operative intensifier.

The use of two intensifiers spaced radially outward from the center of the injector has the advantage of allowing direct needle control through the axis of the injector. In particular, member 54, which might be in one or more sections (more than one section being illustrated), extends all the way from the top of the needle 20 to a pressure chamber 56 at the top of the injector. Thus when actuation fluid control valve 58 applies pressure to the chamber 56, member 54 is hydraulically urged downward to close the needle by the actuation fluid pressure acting on the top piston area of member 54, the various parts in the preferred embodiment being proportioned to assure that the needle will positively close against intensified pressure in the needle chamber.

For initial needle closure, a boost system is used which assures rapid needle closure. In particular, the hydraulic pressure in chamber 56 also acts on the top of member 60, a boost piston which, as may be seen at the left side of FIG. 2, pushes down on pins 62, only one of the pins being shown in FIG. 2 as the other half of the cross-section is taken only ninety degrees therefrom. Pins 62 in turn push on pin 64 which pushes against member 66, which in turn pushes the needle 20 toward the closed position. However the bottom of member 66 will hit the top of member 26 before the needle finally closes, which substantially reduces the impact of needle closure, thereby allowing a very fast needle closure without risk of breaking the tip off of the needle chamber. Note that the stop for the boost assembly is relatively near the needle, minimizing the effects of differential expansion so that the boost may be repeatedly operative until just before needle closure. However the control valve 58 is located at the top of the injector, simplifying the electrical connections to the control valve. Also because all control valves, preferably solenoid actuated spool valves, are similarly located, actuation coils for all three valves may be printed on a multiplayer printed circuit board, further simplifying the electrical interconnection of components. Also the use to two intensifier assemblies allows use of smaller (faster) control valves.

By control of control valve 58, the needle 20 may be pushed downward to the closed position independent of the pressure in the needle chamber around the needle. Coil spring 68, a relatively light coil spring, merely assures that needle closure pin 54 remains at rest against the needle whether the needle is open or closed.

Thus to close the needle in the presence of intensified fuel, control valve 58 is open to provide fluid pressure in chamber 56, with pin 54 as well as the boost assembly just described, accelerating the needle toward the closed position, the boost being stopped just before the needle reaches the closed position to greatly reduce the inertia, and thus the impact on needle closure. In a preferred embodiment, the actuation fluid for the intensifier pistons 42 and 44 and for pin 54 and member 60 is engine oil, though other fluids such as fuel may be used if desired.

The advantages of using two intensifier assemblies as hereinbefore described are numerous. If the intensification ratios are different, then with a single actuation fluid pressure, two different injection pressures may be selectably obtained by operating one or the other intensifier. Two intensifier assemblies are still advantageous, even if they have the same intensification ratios. In particular, fuel injectors in general require a substantial amount of power. In the prior art, intensifiers are typically operated once for each injection and then depressurized to refill the intensifier chamber with fuel. Obviously the intensifier chamber must be large enough to intensify enough fuel for a single injection under the maximum requirements for the engine. Since injection pressures being used or desired to be used are 30,000 psi and higher, and fuel typically has a compressability of approximately one percent per 1,000 psi, the fuel to be injected is compressed approximately twenty to thirty percent. In addition to compressing the fuel to be injected, there is also some overhead volume associated with the intensified fuel, including passages to get the intensified fuel to the needle chamber, and of course, the needle chamber itself. In the prior art, this full amount of energy required to pressurize fuel for maximum injection is used, independent of the engine operating conditions, even at engine idle.

In the present invention, however, at lighter engine loads where less fuel must be delivered to the combustion chamber, only a single intensifier assembly may be operated, thus essentially reducing the power required by the injector by fifty percent, assuming that not only are the intensification ratios the same, but also the intensifier pistons themselves are of the same diameter.

As an alternative, intensification ratios could be the same though one intensifier assembly could have twice the area, or twice the stroke (FIG. 3), or some combination of area and stroke differences to have twice the intensified fuel capacity of the other. Now when full injection is required, both intensifier assemblies could be used. When the engine is running at a lighter load only the larger intensification assembly might be used, and when running at a still lighter load, only the smaller intensification injection assembly may be used, thereby saving a very substantial amount of the energy otherwise required by injectors of the prior art.

Figure 3:
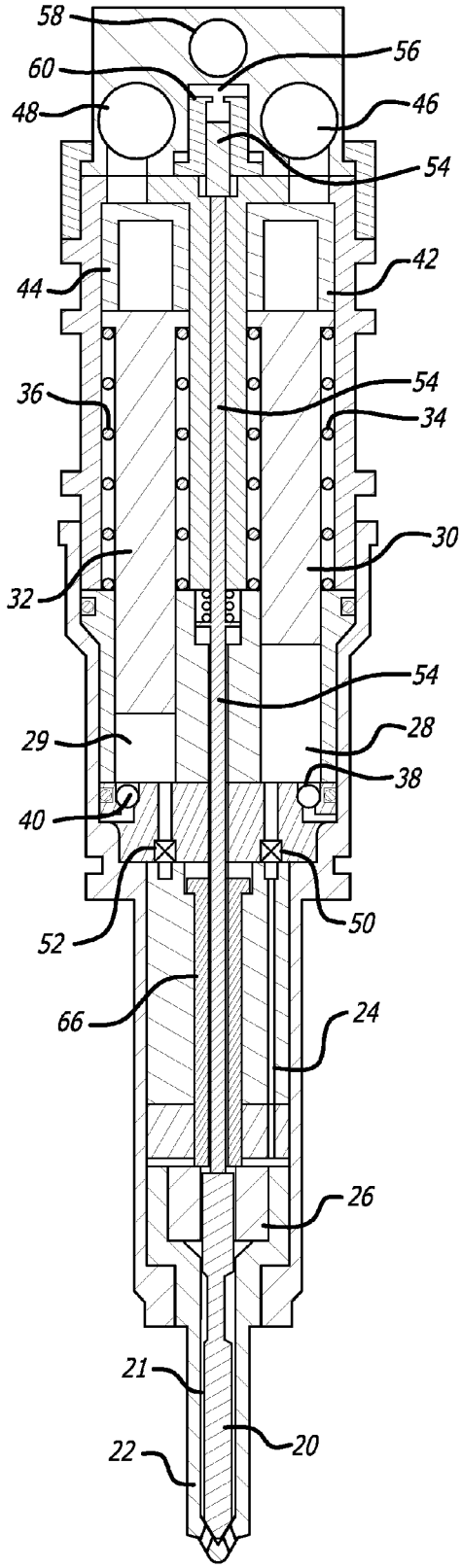
FIG. 3 is a cross section of another embodiment of the present invention.

Another way of operating injectors in accordance with the present invention, or even single intensifier assembly injectors having direct needle control, is as follows. First intensify at least as much fuel as required to at least meet the maximum injection requirements for a single injection event for that engine. (A single injection event may include, for example, a pre-injection, followed by a main injection.) However when the engine is operating under a lighter load, rather than depressurize and repressurize the intensifier assembly to depressurize and repressurize fuel for injection as is now done, simply maintain actuation fluid pressure over the intensifier, but control injection itself by control of the needle, such as, by way of example, is shown in FIGS. 1, 2 and 3.

Such operation can save a large fraction of the power required to operate the injector by simply intensifying once for multiple injections, the number of injections depending on the engine load and easily determined by the controller controlling the amount of fuel injected on each injection. For instance, using the present invention at idle, perhaps only one intensifier assembly need be operated with a single intensification providing six or more injections before needing to depressurize the intensifier to refill with fuel for intensification for subsequent injections. Thus the energy used in intensification may readily be made dependent on engine load conditions, and very substantially reduced as engine load is very substantially reduced. Thus while the prior art intensifies the maximum charge required for the engine, whether or not the maximum charge injection is required, the present invention may either intensify only the approximate amount of fuel needed for injection, or intensify a larger amount of fuel than needed for one injection, but maintain intensification for two or more injections, or both. The electronic control system for the injector valves may readily keep track of the amount of fuel injected on each injection to predict when re-intensification would be needed without requiring a feedback measurement. The electronic control may, by way of example, determine whether after an injection event, there remains enough intensified fuel for an equal injection event. If so, intensification is continued after the needle control closes the needle and the next injection event is executed through needle control, that injection event being limited to the amount of fuel at the intensified pressure that can be injected if the engine power setting has increased.

Thus while certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. A method of operating a fuel injector with direct needle control in an engine comprising:

a) pressurizing by an intensifier in the fuel injector, to an injection pressure, a quantity of fuel at least adequate for one injection event when the engine is operating at full power;

b) controlling an injection event by direct needle control wherein a valve controls an actuation fluid pressure on a piston area, the piston area acting directly on the needle to controllably: 1) hold the needle in a closed position against pressurized fuel in a needle chamber and 2) allow pressurized fuel in the needle chamber to move the needle to an open position for fuel injection;

c) when the amount of pressurized fuel remaining after an injection event is at least adequate for a subsequent injection event, maintaining the pressure on the fuel for a subsequent injection event; and, d) when the amount of pressurized fuel remaining after an injection event is not adequate for a subsequent injection event, depressurizing the fuel and repeating a) through d).

2. The method of claim 1 wherein in a), the pressurizing is controlled by control of an actuation fluid for the intensifier.

3. The method of claim 2 wherein the actuation fluid is engine oil.

4. The method of claim 2 wherein the actuation fluid is fuel.

5. A method of operating a fuel injector with direct needle control in a diesel engine comprising:

a) pressurizing by an intensifier in the fuel injector, to an injection pressure, a quantity of fuel at least adequate for one injection event when the engine is operating at full power;

b) controlling an injection event by direct needle control wherein a valve controls an actuation fluid pressure on a piston area, the piston acting directly on the needle to controllably: 1) hold the needle in a closed position against pressurized fuel in a needle chamber and 2) allow pressurized fuel in the needle chamber to move the needle to an open position for fuel injection;

c) when the amount of pressurized fuel remaining after an injection event is at least adequate for a subsequent equal injection event, maintaining the pressure on the fuel for a subsequent injection event; and, d) when the amount of pressurized fuel remaining after an injection event is not adequate for a subsequent equal injection event, depressurizing the fuel and repeating a) through d).

6. The method of claim 5 wherein in a), the pressurizing is controlled by control of an actuation fluid for the intensifier.

7. The method of claim 6 wherein the actuation fluid is engine oil.

8. The method of claim 6 wherein the actuation fluid is fuel.

9. A method of operating a fuel injector with direct needle control in an engine comprising:

a) pressurizing by an intensifier in the fuel injector, to an injection pressure, a quantity of fuel at least adequate for one injection event when the engine is operating at full power;

b) controlling an injection event by direct needle control;

c) when the amount of pressurized fuel remaining after an injection event is at least adequate for a subsequent injection event, maintaining the pressure on the fuel for a subsequent injection event, an injection event comprising at least a pre-injection followed by a main injection, and, d) when the amount of pressurized fuel remaining after an injection event is not adequate for a subsequent injection event, depressurizing the fuel and repeating a) through d).

10. The method of claim 9 wherein in a), the pressurizing is controlled by control of an actuation fluid for the intensifier.

11. The method of claim 10 wherein the actuation fluid is engine oil.

12. The method of claim 10 wherein the actuation fluid is fuel.

13. A method of operating a fuel injector with direct needle control in a diesel engine comprising:

a) pressurizing by an intensifier in the fuel injector, to an injection pressure, a quantity of fuel at least adequate for one injection event when the engine is operating at full power;

b) controlling an injection event by direct needle control;

c) when the amount of pressurized fuel remaining after an injection event is at least adequate for a subsequent equal injection event, maintaining the pressure on the fuel for a subsequent injection event, an injection event comprising at least a pre-injection followed by a main injection, and, d) when the amount of pressurized fuel remaining after an injection event is not adequate for a subsequent equal injection event, depressurizing the fuel and repeating a) through d).

14. The method of claim 13 wherein in a), the pressurizing is controlled by control of an actuation fluid for the intensifier.

15. The method of claim 14 wherein the actuation fluid is engine oil.

16. The method of claim 14 wherein the actuation fluid is fuel.

* * * * *